US005361974A

United States Patent [19]

Earl et al.

[11] Patent Number: 5,361,974

[45] Date of Patent: Nov. 8, 1994

[54] BOX CONSTRUCTION

[75] Inventors: Gary L. Earl, Hoquian; William A. Goodwin, Longview, both of Wash.

[73] Assignee: Anderson & Middleton Company, Hoquiam, Wash.

[21] Appl. No.: 68,132

[22] Filed: May 27, 1993

[51] Int. Cl.[5] ..... B65D 5/32

[52] U.S. Cl. ..... 229/23 R; 229/916; 229/919

[58] Field of Search ..... 229/23 R, 160, 169, 229/915, 916, 919

[56] References Cited

U.S. PATENT DOCUMENTS

| | | | |
|---|---|---|---|
| 2,950,852 | 8/1960 | Hutchison | 229/199 |
| 3,015,431 | 1/1962 | Mulcoy | 229/915 |
| 3,373,921 | 3/1968 | Crane | 229/23 R |
| 3,709,425 | 1/1973 | Stapp | 229/199 |
| 3,713,579 | 1/1973 | Chaffers | 229/23 R |
| 3,905,541 | 9/1975 | Paxton | 229/23 R |
| 3,935,991 | 2/1976 | Crane | 229/23 R |
| 3,946,934 | 3/1976 | Chaffers | 229/23 R |
| 4,068,794 | 1/1978 | Lawrence | 229/23 R |
| 4,175,691 | 11/1979 | Cornell et al. | 229/915 |
| 4,389,013 | 6/1983 | Hall et al. | 229/915 |
| 4,458,838 | 7/1984 | Lacasa et al. | 229/199 |
| 4,645,122 | 2/1987 | Nederveld | 229/23 R |
| 4,709,852 | 12/1987 | Stoll | 229/915 |
| 4,911,356 | 3/1990 | Townsend et al. | 229/23 R |
| 5,116,290 | 5/1992 | Ross | 229/23 R |
| 5,203,494 | 4/1993 | Blomfield | 229/919 |

FOREIGN PATENT DOCUMENTS

| | | | |
|---|---|---|---|
| 2449605 | 9/1980 | France | 229/919 |

OTHER PUBLICATIONS

The Wiley Encyclopedia of Packaging Technology, John Wiley & Sons, (1986) pp. 66–71.

*Primary Examiner*—Gary E. Elkins
*Attorney, Agent, or Firm*—Nixon & Vanderhye

[57] ABSTRACT

A box construction includes an integral bottom panel, opposite side panels, opposite end panels and a pair of partial top panels, wherein the opposite end panels extend a full depth dimension of the box construction, and wherein each of the opposite end panels is provided with a minor flap portion at an upper end thereof. The minor flap portions are adapted to be folded to a substantially horizontal orientation such that the minor flap portions will be engaged by a respective ones of the partial top panels when the box is closed. A reinforcing end panel is adhered to interior sides of each of the opposite end panels, each reinforcing end panel having a pair of stacking projections extending from an upper edge of the reinforcing panel. Each reinforcing end panel is also formed with a pair of cut-outs along a lower edge thereof which cooperate with apertures in the bottom panel to provide stacking recesses adapted to receive stacking projections of an identical underlying box in a stacking arrangement.

21 Claims, 8 Drawing Sheets

BOX CONSTRUCTION

BACKGROUND AND SUMMARY OF THE INVENTION

This invention relates to a novel box construction which is particularly useful in the harvesting and packing of small fruits such as grapes. The box construction in accordance with the invention, however, has equal applicability, and provides similar advantages, when used for packaging and shipping of many other products as well.

Box constructions for use in the harvesting of agricultural crops, and especially small fruits are well known. Such boxes are usually required to have an overall design which provides strength sufficient to provide good stacking and cold storage characteristics. Such boxes are typically made of corrugated cardboard, and include a bottom panel, side panels, end panels, and partial top panels which are foldable to a closed and releasably locked position. Such boxes have not to date included full depth end panels. Rather, conventional boxes utilize separate reinforcing end panels, each of which is glued in place to as many as three relatively small end flap extensions, as will be described in greater detail hereinbelow. The reinforcing end panels are also in some cases formed with minor flap portions which are located at the upper ends of the reinforcing panels, and which are foldable to a horizontal position to provide some support for the partial top panels when the latter are folded to the closed position.

In addition, conventional boxes are designed for stacking and, to this end, the upper ends of the reinforcing end panels are formed with upstanding projections, and the lower ends of the reinforcing end panels are formed with recesses, so that the projections of one box may be received within the recesses of an overlying box.

There are a number of disadvantages with the known box construction. For example, the end panel arrangement comprised of relatively small flap extensions on the box blank in combination with separate reinforcing end panels, precludes any ability to print all of the necessary information on the box in a single operation. In other words, since the major portion of the box ends are formed by the discrete and separate reinforcing end panels, it is necessary to print these reinforcing end panels separately, and then to associate the printed end panels with similarly printed box blanks prior to assembly. This a time consuming and labor intensive operation. In addition, the stacking recesses are exposed on the box ends so as to even further limit the surface area of the box ends which can be printed.

The present invention provides a unique box construction which overcomes the problems associated with the above described conventional box constructions, and provides additional strength benefits advantages as well.

In accordance with an exemplary embodiment of the invention, the box blank is formed with integral, full depth end panels which, in combination with the separate reinforcing end panels. This configuration provides added strength to the box which not only enhances the stacking ability of the box, but also its cold storage capability as well.

In addition, the stacking apertures have been confined to the bottom panel, i.e., they do not intrude into the full depth end panels, so that the full depth of each integral end panel is available for printing. This, of course, also means that the entire box blank can be printed in a single operation. More specifically, the reinforcing end panels are located interiorly of the integral, full depth end panels, and they are therefore essentially completely hidden from view (when the box is viewed exteriorly). Thus, printing is neither desirable nor necessary on the reinforcing end panels. All printing may thus be applied to one side of the box blank, i.e., that side which forms the exterior surfaces of the various box panels, in a single operation, preferably simultaneously with the die-cutting of the box blank.

It is a further feature of this exemplary embodiment of the invention that minor flap extensions are provided at the upper ends of the full depth side panels. These minor flap extensions are foldable to a horizontal position to provide support for the partial top panels when the latter are folded to a closed position. Because these minor flap extensions are now made an integral part of the box blank via connection to the full depth end panels, and because of the greater surface adhesion area between the full depth end panels and the reinforcing end panels, increased stacking and cold storage strength characteristics are imparted to the box construction.

In one aspect, therefore, the present invention relates to a box construction comprising an integral bottom panel, opposite end panels and a pair of partial top panels, wherein the opposite end panels extend a full depth dimension of the box construction, and wherein each of the opposite end panels is provided with a minor flap portion at an upper end thereof, the minor flap portion adapted to be folded to a substantially horizontal orientation such that the minor flap portion will be engaged by a respective one of the partial top panels when the box is closed; and further wherein a reinforcing panel is adhered to interior sides of each of the opposite end panels, each reinforcing panel having at least on stacking projection extending from an upper edge thereof.

In another aspect, the present invention relates to a box blank for forming a box, the blank comprised of a substantially planar sheet having opposite longitudinal extending marginal edges and having defined therein in a longitudinal direction of the blank a first partial top panel, a first side panel, a bottom panel, a second side panel and a second partial top panel; and wherein first and second full box depth end panels extend transversely from the bottom panel, the first and second end panels having respective first and second minor flap portions along respective outer ends thereof.

The box construction in accordance with the present invention, as described generally above, and in greater detail below, provides the following benefits:

(1) increases stacking strength;
(2) eliminates need to separately print the end panels;
(3) provides greater cold storage ability due to strength in the box structure;
(4) compatibility with present box forming equipment;
(5) enhances the appearance of box end panels due to flat end designs;
(6) hides the bottom stacking recesses for full end panel printing;
(7) adaptability of box design to handle various fruit crops; and
(8) provides full depth exterior end panels for greater attachment adhesion to interior reinforcing end panels.

Other objects and advantages will become apparent from the detailed description which follows.

DETAILED DESCRIPTION OF THE DRAWINGS

Figure 1:
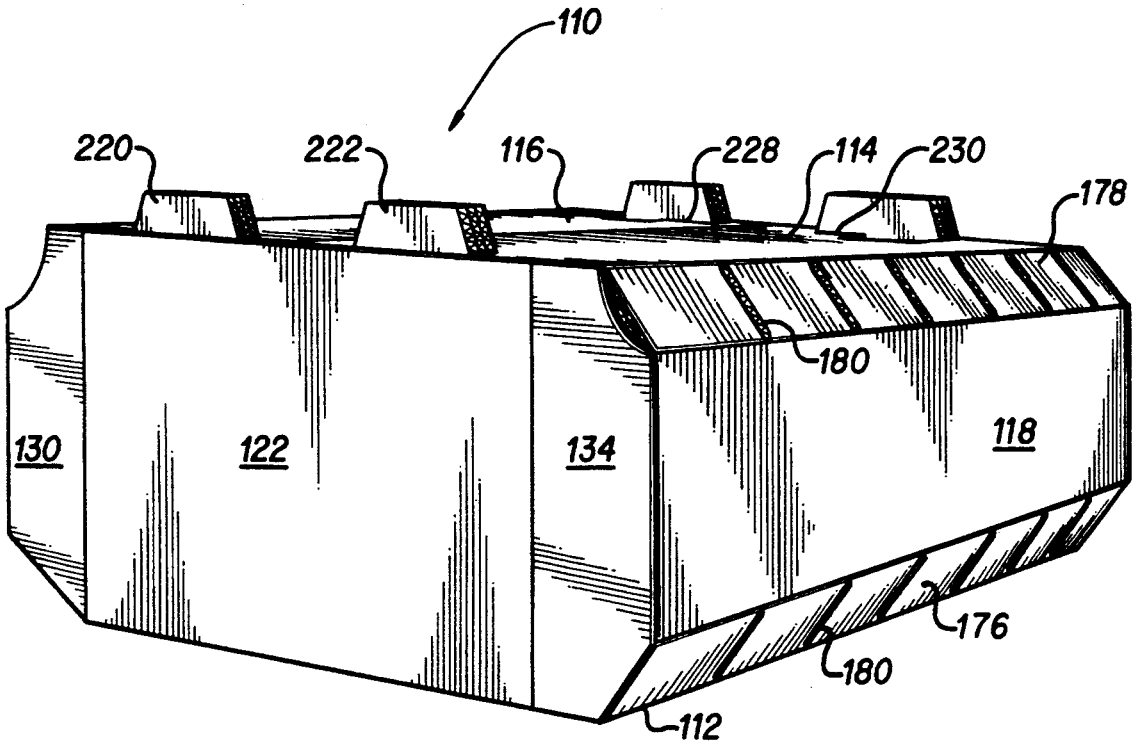
FIG. 1 is a perspective view of a box construction in accordance with this invention.

Referring to FIG. 1, the box 110 in accordance with this invention includes, generally, a bottom panel 112, a pair of side panels 118 and 120 (only panel 118 shown in FIG. 1, but also see FIGS. 5 and 9), a pair of end panels 122, 124 (only panel 122 shown in FIG. 1, but also see FIGS. 5 and 9), and partial top panels 114 and 116. Top panels 114 and 116 are closed by a folding movement toward the center of the box. The top panels are then locked in place (after loading of the contents) as described in greater detail below.

Before explaining the present invention in detail, however, it will be helpful to understand the conventional box construction over which this invention constitutes a significant improvement. Thus, with reference to FIGS. 2 and 3, a conventional cardboard box blank 10 is die cut from a sheet of corrugated cardboard to provide a bottom panel 12; a pair of partial top panels 14 and 16; a pair of side panels 18 and 20; and a pair of partial depth end panels 22, 24. Side panels 18 and 20 each have a pair of flap extensions 26, 28 and 30, 32, respectively, which ultimately form part of the box ends, as described in greater detail below.

In the longitudinal direction of the box blank (indicated by double arrow A), it will be appreciated that the partial end panel 22 and the side panel flap extensions 26, 30 are foldable along a discontinuous, longitudinally extending fold line 32, and fold lines 34, 36, respectively, all of which lie along a first longitudinally extending marginal edge 38 of the blank. Similarly, the partial depth end panel 24 and side panel flap extensions 28 and 32 are foldable along a discontinuous fold line 40, and fold lines 42, 44, all of which lie along a second longitudinally extending marginal edge 46 of the blank.

Figure 2:
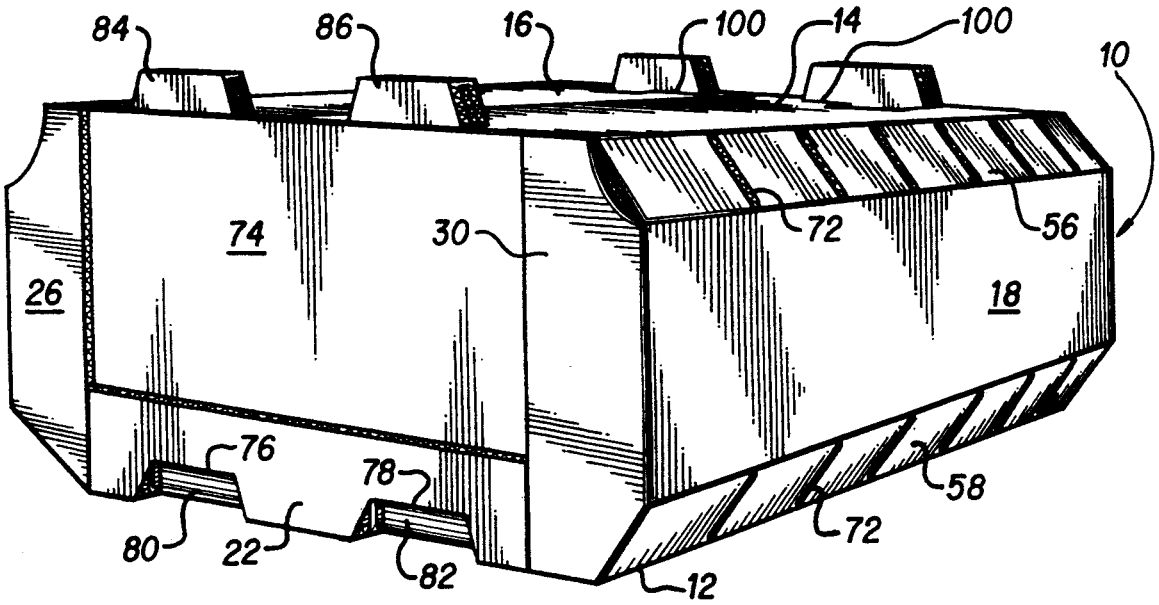
FIG. 2 PRIOR ART
FIG. 2 is a perspective view of a conventional prior art box construction.

Side panel 18 is formed with longitudinally spaced, transverse pairs of fold lines 48, 50 and 52, 54 extending transversely between marginal edges 38 and 46. Fold line 54 lies at the interface between bottom panel 12 and side panel 18, while fold line 48 lies at the interface between side panel 18 and partial top panel 14. At the same time, the transverse pair of fold lines 48, 50 define a first transversely extending transition strip 56, while fold lines 52 and 54 define a second, transversely extending transition strip 58. In the finally folded and assembled form, the transition strip 56 is oriented at an approximately 45° angle between the substantially horizontal bottom panel 12 and the substantially vertical side panel 18, while transition strip 58 is similarly oriented between the substantially horizontal (when closed) top panel 14 and the substantially vertical side panel 18, as best seen in FIG. 2.

Similarly, side panel 20 is formed with longitudinally spaced, transverse pairs of fold lines 60, 62 and 64, 66 which define third and fourth transition strips 68, 70, respectively, and which are otherwise arranged identically to the fold lines 48, 50, 52 and 54 and their associated transition strips 56, 58. All four transition strips are each provided with a plurality of vent apertures 72.

Figure 3:
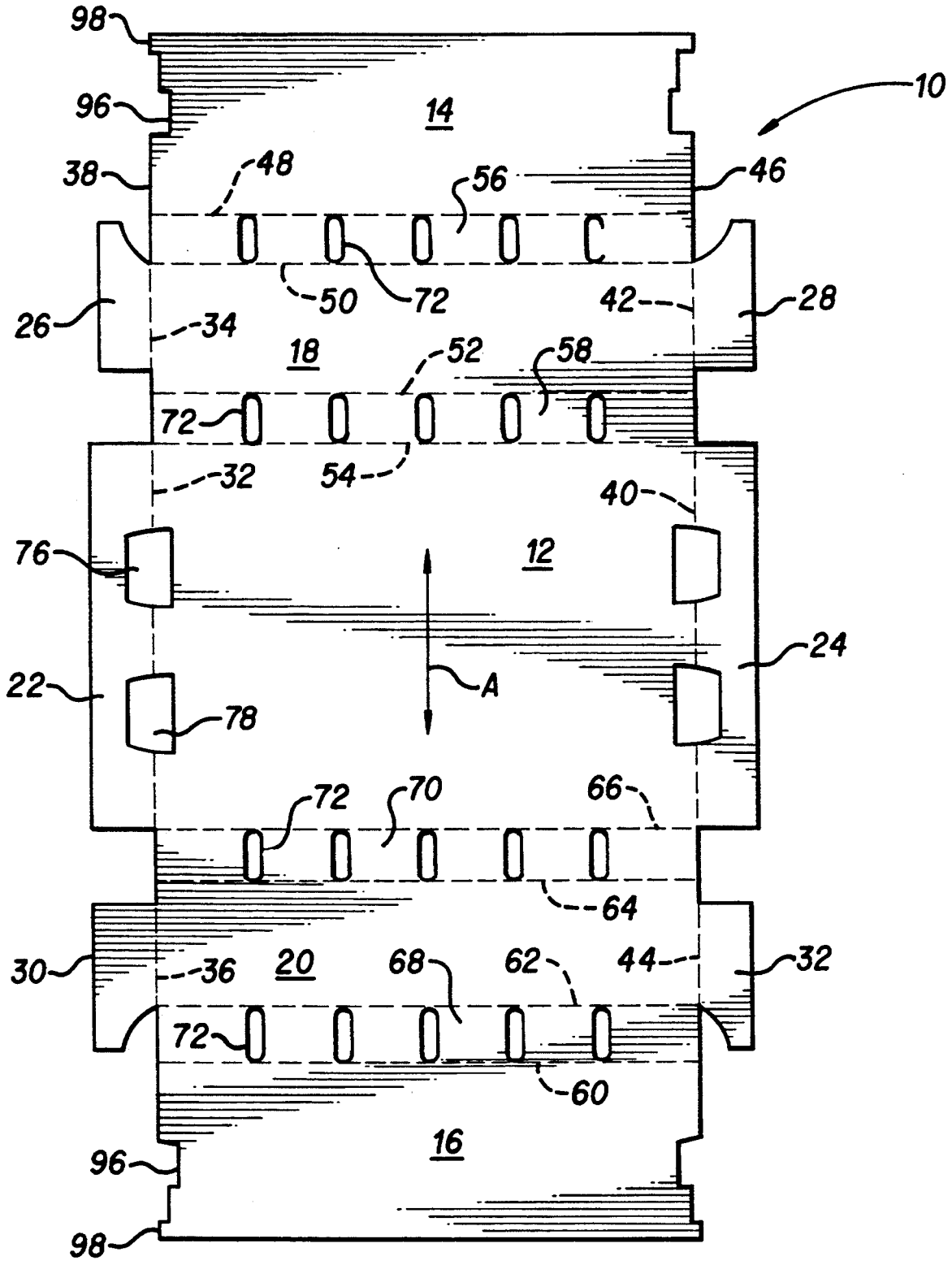
FIG. 3 PRIOR ART
FIG. 3 is a plan view of a box blank used to form the prior art box illustrated in FIG. 2.

With reference now to FIG. 3, a conventional reinforcing end panel 74 is formed by a three-fold layer of corrugated cardboard, and one such panel is designed to be glued in place to the partial end panel 22, and flap extensions 26 and 30 at one end of the box, and another such reinforcing end panel is glued in place to the partial end panel 24, and flap extensions 28 and 32 at the other end of the box. In this regard, it will be appreciated that upon folding of the side panels 18 and 20 about fold lines 54 and 66, respectively, and upon folding of the partial end panel 22 and flap extensions 26 and 30, the panel 22 and flap extensions 26 and 30 will lie in a substantially vertical plane, and provide flat, vertical surfaces for receiving a reinforcing panel 74 in a hot or cold glued relationship. The other reinforcing end panel is secured in a similar manner at the opposite end of the box. As will be appreciated from FIG. 2, the box end arrangement at one end of the conventional box construction consists primarily of the reinforcing end panel 74 which is glued to the inside surfaces of partial end panel 22 and flap extensions 26 and 30, thus providing an uneven box end surface, with only limited printing space. The presence of stacking apertures 76 and 78 (and aligned recesses 80 and 82 in the panel 74) even further limit the available printing space on the box end. The box end at the other end of the box is, of course, identical to that shown in FIG. 2.

Figure 4:
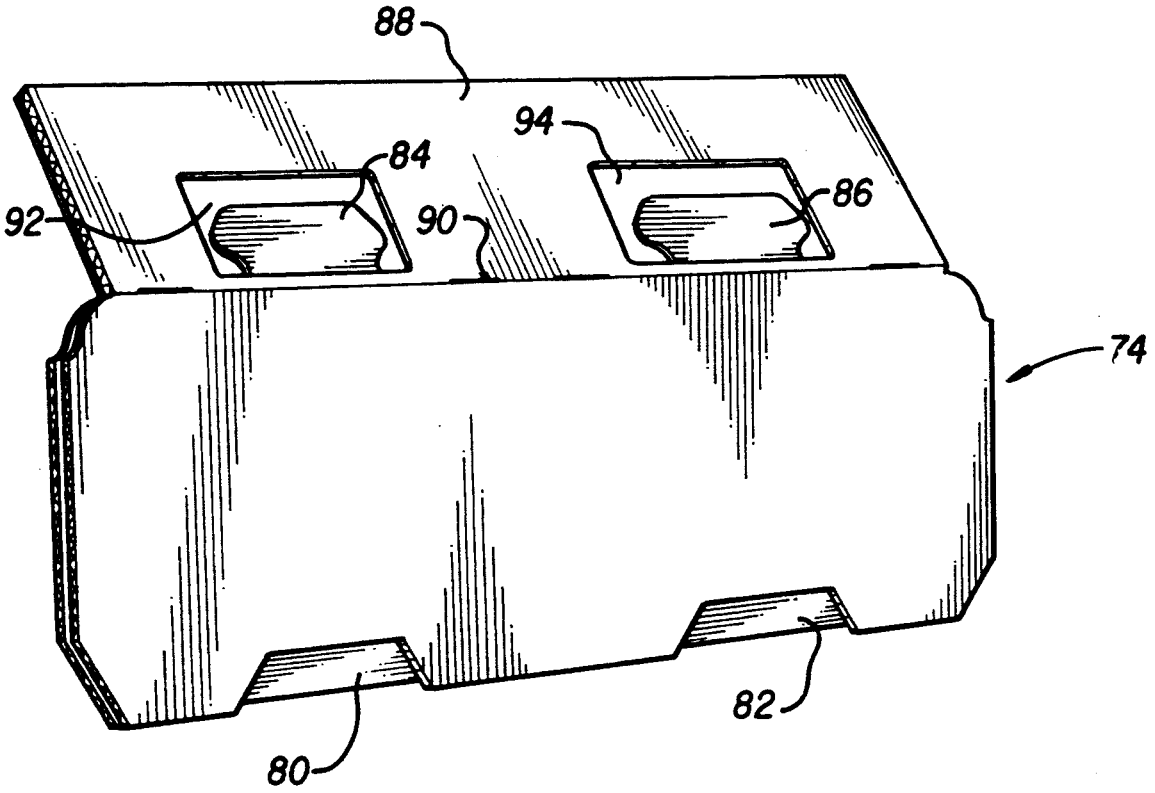
FIG. 4 PRIOR ART
FIG. 4 is a perspective view of an end reinforcing panel used in the prior art box construction illustrated in FIG. 2.

Returning to FIG. 4, the reinforcing end panel 74 is also provided along an upper end thereof with a pair of upstanding projections 84, 86 and may (optionally) also include a minor flap portion 88 foldable about a fold line 90 (absent the minor flap portion 88, line 90 would constitute the upper edge of the end reinforcing panel 74). If present, the minor flap portion 90 is formed with apertures 92, 94 to permit folding of the minor flap portion 88 to a horizontal orientation. In use, the minor flap portion 88 is folded to the horizontal orientation after loading the contents in the box, and thus provides some support for the partial top panels 14, 16 when the latter are moved to a closed position. In this regard, note also that the partial top panels 14 and 16 are formed with cut outs 96 (two labelled in FIG. 3) which accommodate the projections 84, 86, and tabs 98 (two labelled in FIG. 3) which are adapted to be received in slots 100 (two shown in FIG. 2) provided in the interior surface of projections 84, 86 (the exterior surface is shown in FIG. 4). This arrangement enables the partial top panels 14, 16 to be releasably locked in the closed position shown in FIG. 2. At the same time, projections 84, 86 (and identical projections on the other reinforcing panel) are available for reception in the stacking recesses formed by apertures 76, 78 and associated reinforcing end panel recesses 80, 82 of an identical overlying box in a stacked arrangement.

As already noted, FIG. 1 illustrates the improved box 10 in accordance with this invention, in its fully folded and assembled form. The box is constructed essentially from three pieces of corrugated cardboard stock (EC or EB double wall or single wall corrugated)—one piece in the form of a pre-cut box blank which is folded to form the bottom, sides, ends and top of the box, and two reinforcing end panels.

Figure 5:
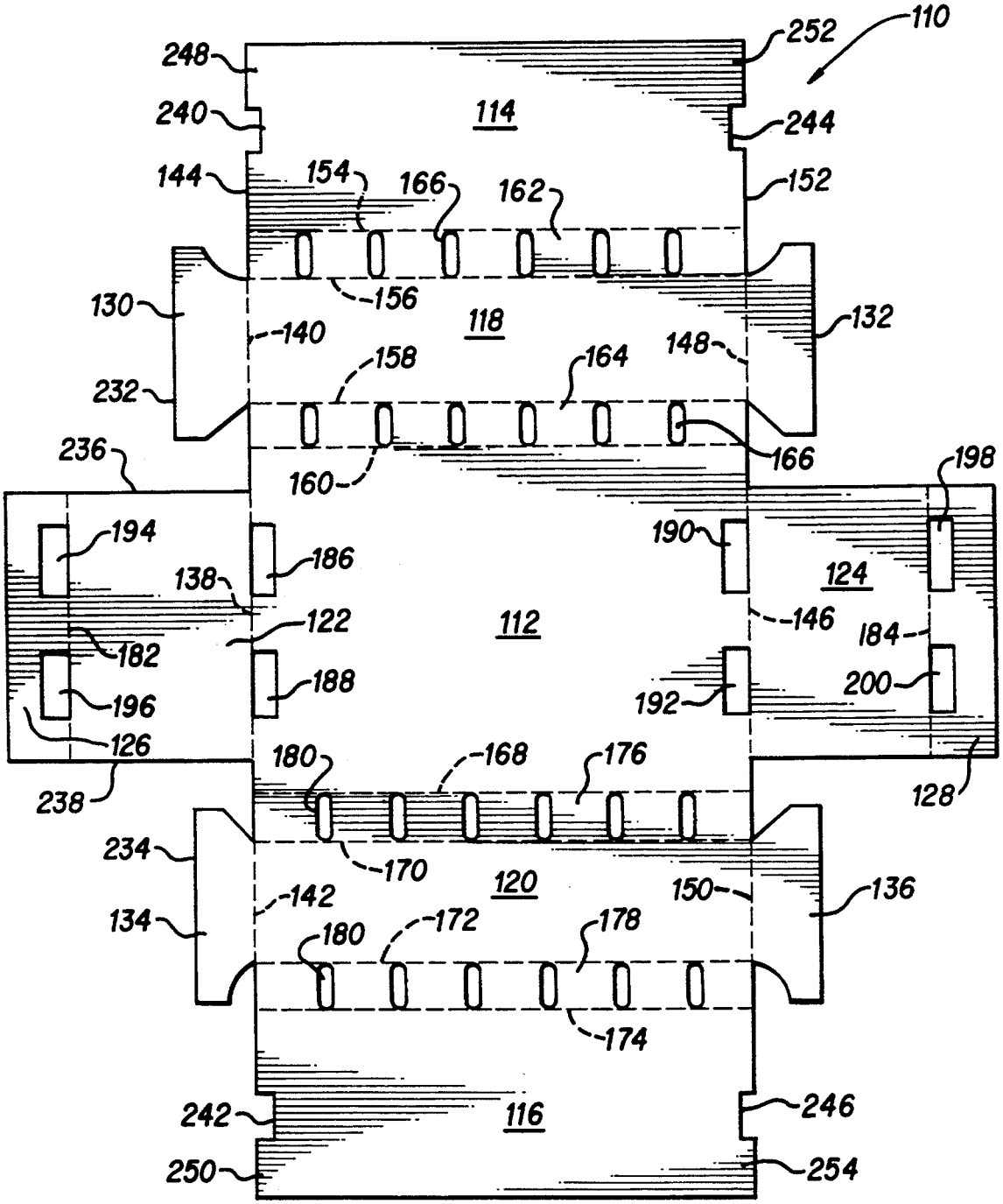
FIG. 5 is a plan view of a box blank in accordance with this invention.

More specifically, and with reference to FIG. 5, the box blank 110 of this invention is die cut from a corrugated cardboard sheet to provide generally a bottom panel 112, a pair of partial top panels 114 and 116, a pair of full depth but partial width side panels 118 and 120, and a pair of end panels 122, 124. The end panels 122 and 124 each have a minor flap extension 126, 128, respectively, which ultimately form part of the top of the box as described in greater detail below. From FIG. 5, it will be appreciated that the combined width dimension of each of the opposite end panels and a respective pair of the side panel flap extensions is substantially equal to the width dimension of the bottom panel. At the same time, the side panels 118 and 120 each have a pair of side panel flap extensions 130, 132 and 134, 136, respectively, which ultimately form part of the ends of the box, as also described below. In other words, the box ends are formed by both the full depth, partial width end panels 122, 124 and associated side panel flap extensions 130, 134 and 132, 136, respectively.

In the longitudinal direction of the box blank, it may be seen that the partial end panel 122 and side panel flap extensions 130 and 134 are foldable along a discontinuous fold line 138 and fold lines 140, 142, respectively, which are aligned with a first longitudinally extending marginal edge 144 of the blank. Similarly, the partial end panel 124 and side panel flap extensions 132 and 136 are foldable along a discontinuous fold line 146 and fold lines 148, 150, respectively, which are aligned with a second longitudinally extending marginal edge 152 of the blank.

The side panel 118 is formed with longitudinally spaced, transverse pairs of fold lines 154, 156 and 158, 160 extending between edges 144 and 152. The fold line 160 lies at the interface of the side panel 118 and bottom panel 112, while fold line 154 lies at the interface of the side panel 118 and the partial top panel 114. At the same time, the transverse pair of fold lines 154, 156 define a first transversely extending transition strip 162, while fold lines 158 and 160 define a second transverse transition strip 164. Each of the transition strips 162, 164 is formed with a plurality of vent apertures 166.

Similarly, the side panel 120 is formed with longitudinally spaced, transverse pairs of fold lines 168, 170 and 172, 174, also extending between edges 144 and 152. The fold line 168 lies at the interface of the side panel 120 and the bottom panel 112, while fold line 174 lies at the interface of the side panel 120 and the partial top panel 116. At the same time, the transverse pair of fold lines 168, 170 define a third, transversely extending transition strip 176, while fold lines 172, 174 define a fourth transverse, transition strip 178. Each of the transition strips 176, 178 is formed with a plurality of vent apertures 180. For the sake of convenience and clarity, transition strips 162 and 164 are considered to be part of the side panel 118, while transition strips 176, 178 are considered to be part of the side panel 120. As in the prior art construction, these transition strips extend angularly between the horizontal top and bottom panels of the box and vertical side panels of the box when the blank is folded to its final form (as shown in FIG. 1).

A discontinuous fold line 182 extends along the interface of end panel 122 and the minor flap extension 126, parallel to fold Line 138. Similarly, a discontinuous fold line 184 extends along the interface of end panel 124 and the minor flap extension 128, parallel to fold line 146.

The bottom panel 112 is formed with longitudinally spaced apertures 186, 188 along the discontinuous fold line 138 while similarly shaped apertures 190, 192 are provided along the discontinuous fold line 146.

The minor flap extension 126 is formed with longitudinally spaced apertures 194, 196 along the discontinuous fold line 182, while similarly shaped apertures 198, 200 are provided along the discontinuous fold line 184.

Figure 6:
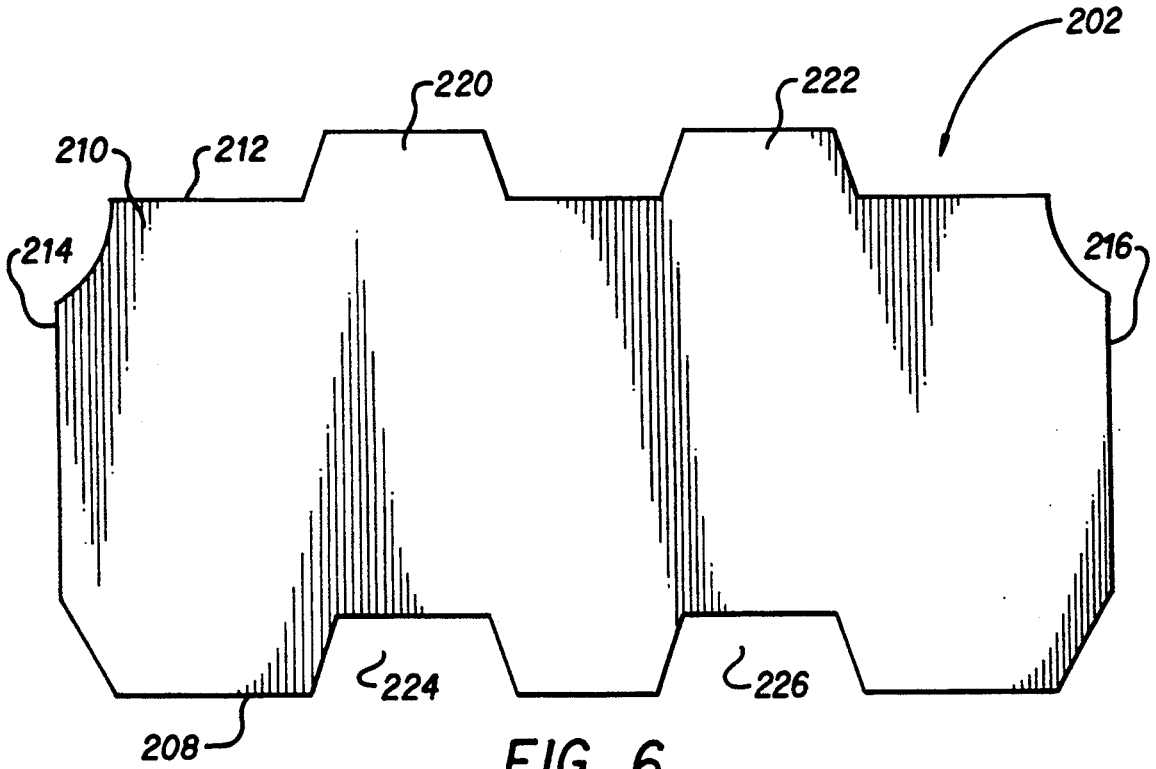
FIG. 6 is a side elevation of a reinforcing end panel in accordance with this invention.
Figure 7:
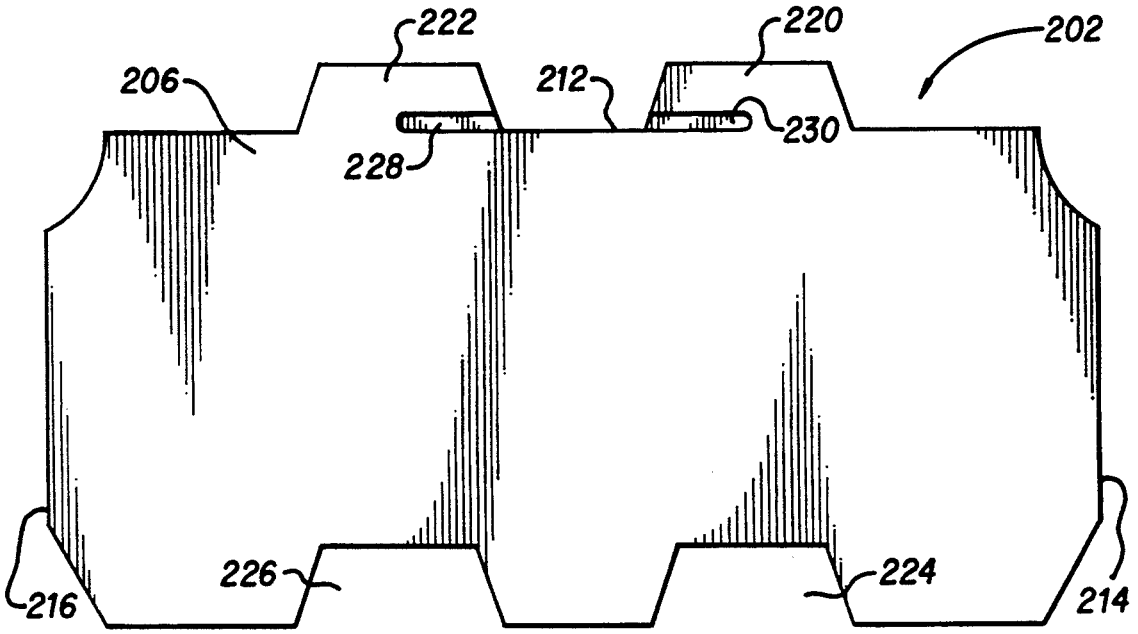
FIG. 7 is a side elevation showing the side of the reinforcing end panel opposite that shown in FIG. 6.
Figure 8:
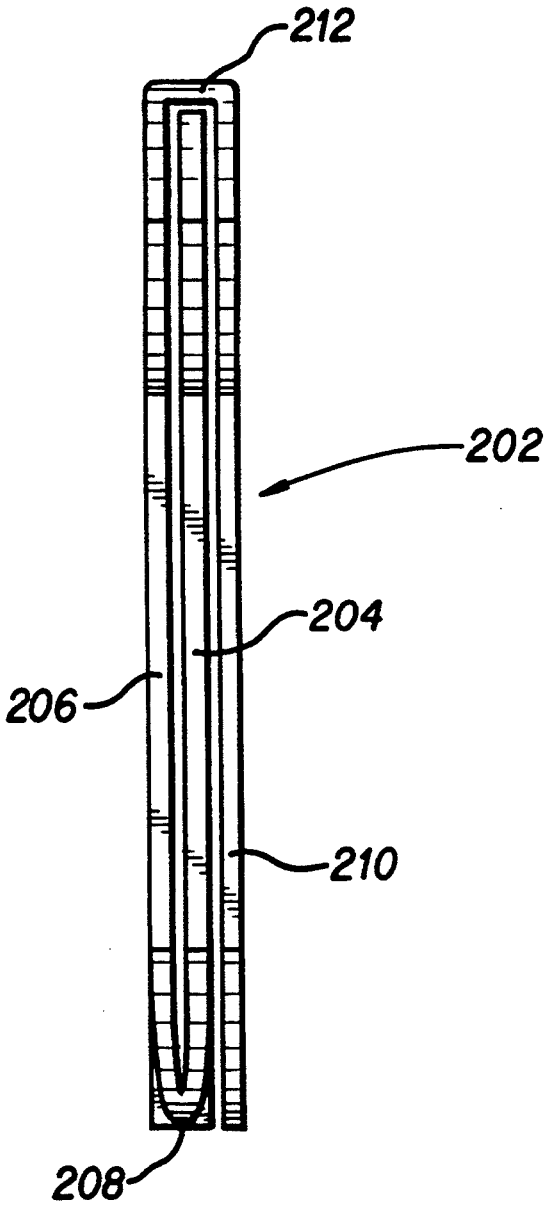
FIG. 8 is an edge view of the reinforcing end panel shown in FIG. 7.

With reference now to FIGS. 6–8, an inner reinforcing end panel 202 in accordance with this invention is illustrated. The panel 202 is a triple thickness panel, formed by folding a single die cut cardboard blank in a manner best seen in FIG. 8. Thus, one end portion 204 of the blank is folded over an intermediate portion 206 of the blank at a lower edge 208. Subsequently, an opposite end portion 210 of the blank is folded over the first end portion 204 at an upper edge 212 which defines the thickness of the panel 202 as a whole. Thus, the intermediate portion 206 of the blank forms the interior side of the finished panel 202, while end portion 210 forms the exterior side of the finished panel 202, and end portion 204 ultimately becomes the middle layer of the finished reinforcing end panel.

With reference especially to FIG. 6, the exterior side 206 of the reinforcing end panel 202 (that side of the panel 202 which faces away from the interior of the box and which is glued to an adjacent end panel 122 or 124) includes side edges 214 and 216, the upper (discontinuous) edge 212, and the lower (discontinuous) edge 208. The panel blank is die-cut so that when folded as described above, a pair of spaced, upstanding projections 220, 222 are formed along edge 212, spaced inwardly of the end edges 214, 216 but also spaced from each other. The reinforcing end panel blank is also pre-cut to provide, when folded as described above, upwardly extending cut outs 224, 226 which are shaped and sized so as to be complimentary to the projections 220 and 222. As will be explained in greater detail below, the recesses 224, 226 are designed to receive projections 220, 222 of an underlying box in a stacking arrangement.

FIG. 7 illustrates the reverse (or interior) side 206 of the reinforcing end panel, 202, i.e., that side which faces the interior of the box. This interior side is identical to the exterior side, with the exception that the middle layer 204 and the interior side 206 of the blank are pre-cut to create opposed narrow slots 228, 230 extending along edge 212 and laterally into the projections 222, 220. Note that the exterior side 210 of the blank is not so cut, and therefore, the slots 228, 230 do not appear on the exterior surface of the panel 202 as viewed in FIG. 6. The purpose of slots 228, 230 will be explained in greater detail below.

Figure 9:
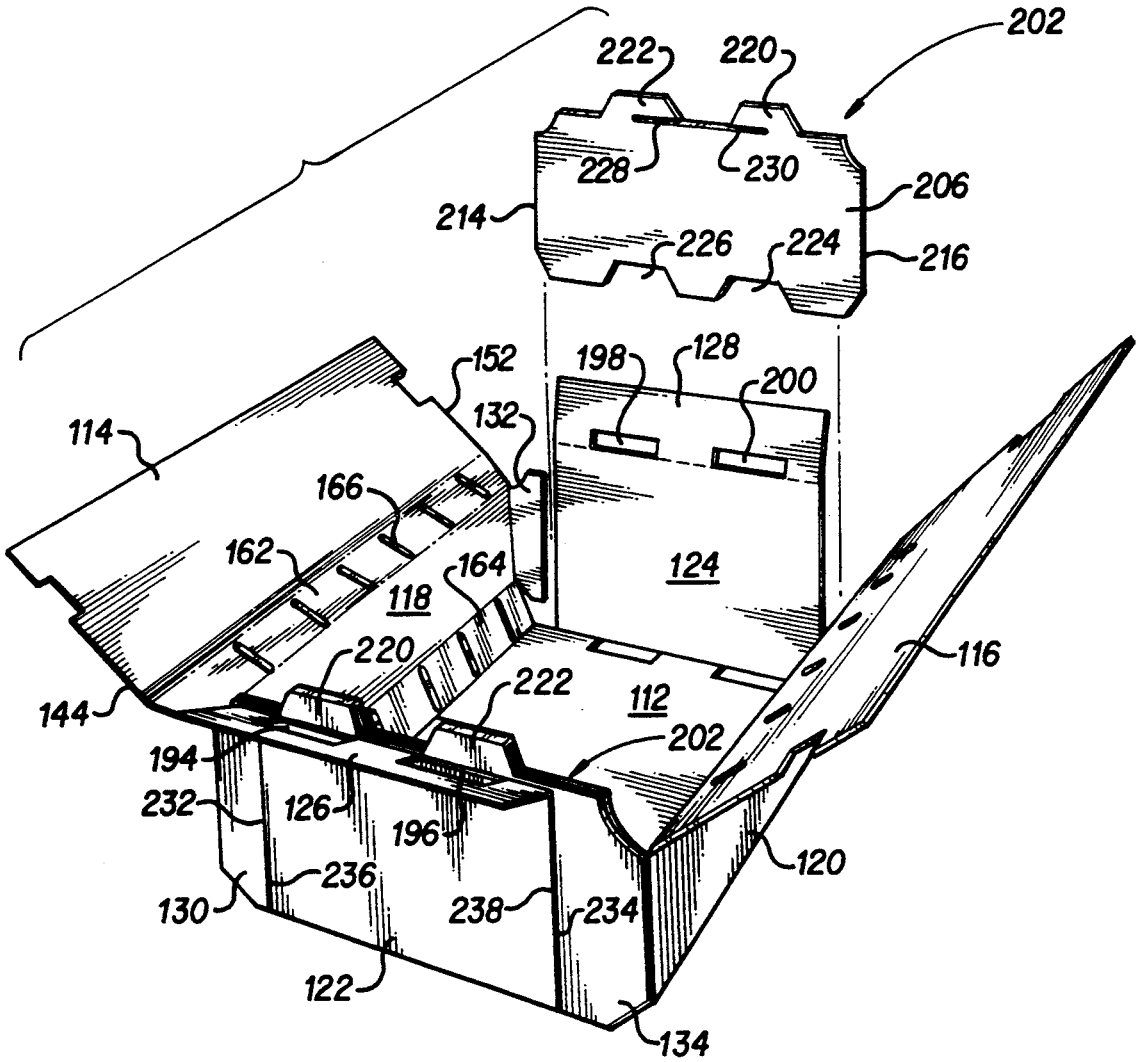
FIG. 9 is a perspective view, in partially exploded form, of the box construction accordance with this invention.

With reference now to FIG. 9, the box blank 110 is formed by folding side panels 118 and 120 upwardly about respective fold lines 160, 158 and 168, 170. Full depth end panels 122 and 124 are folded upwardly along respective fold lines 138 and 146, and side panel flap extensions 130, 132, 134 and 136 are then folded inwardly along respective fold lines 140, 148, 142 and 150. One reinforcing end panel 202 is then glued in place to the interior surface of the full depth end panel 122, and the now aligned flap extensions 130, 132 to provide a substantially smooth and continuous box end, best seen in FIG. 1. In this regard, edges 232, and 234, respectively, of flap extension 130, 134 abut edges 236, 238, respectively, of the full depth end panel 122. Because a substantially solid and continuous box end surface is established for adhesive connection to the exterior side 210 of the reinforcing end panel 202, a significantly strengthened box end is achieved. A similar folding and assembling process is carried out at the opposite end of the box. It should be noted here that the box blank 110 may be folded and assembled with existing equipment, such as an SWF Model 1T4 or 1T6 Tray-Matic with SWF Bliss-Matic machine attachments.

With the reinforcing end panels 202 glued in place, the apertures 186, 188 (and 190, 192) in the box bottom panel 112 will lie directly under the cut-outs 224, 226 in the respective reinforcing end panels to thereby create stacking recesses which are not visible from the sides of the box. As a result, the surface area on the box ends available for printing is increased as compared to the conventional box shown in FIG. 2.

After the box is loaded with contents, the minor flap portions 126 and 128 may be folded inwardly along respective fold lines 182 and 146 to a substantially horizontal orientation. In doing so, the apertures 194, 196 and 198, 200 will accommodate the projections 220 and 222 on each reinforcing end panel 202. The partial top panels 114 and 116 may then be folded inwardly toward the center of the box about fold lines 154 and 174, respectively, in overlying relationship to the minor flap portions 126, 128. Cut outs 240 and 242 along edge 144 and similar cut outs 244, 246 along edge 152 will enable the partial top panels 114 and 116 to accommodate the projections 220, 222 on each reinforcing end panel. At the same time, the adjacent tab portions 248, 250, 252 and 254 on the respective partial top panels 114, 116 may be snapped into place in respective slots 228, 230 formed in the projections 222, 220 as shown in FIG. 1.

The integration of full depth end panels 122 and 124, along with respective minor flap portions 126, 128 into the box blank 110, and the substantial full surface adhesion with the reinforcing end panels 202, provide increased strength to the box, thus enhancing both stacking and cold storage capabilities. This feature, along with the attendant single operation printing benefits already described, result in a superior box construction as compared to conventional box designs.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A box construction comprising an integral bottom panel, opposite side panels, opposite end panels and a pair of partial top panels, wherein said opposite end panels extend a full depth dimension of the box construction, and wherein each of said opposite end panels is provided with a minor flap portion at an upper end thereof, said minor flap portion adapted to be folded to a substantially horizontal orientation such that said minor flap portion will be engaged by a respective one of said partial top panels when the box is closed; and further wherein a reinforcing end panel is adhered to interior sides of each of said opposite end panels, each of said reinforcing end panels having an upper edge and at least one stacking projection extending from said upper edge.

2. The box construction of claim 1 wherein each of said reinforcing end panels is glued to an interior surface of a respective one of said end panels.

3. The box construction of claim 1 wherein said bottom panel is provided with at least one stacking aperture along opposite marginal edges thereof, said at least one stacking aperture located and arranged to receive a stacking projection on a substantially identical underlying box.

4. The box construction of claim 1 wherein each of said side panels is formed with a pair of flap extensions located at opposite ends thereof; and wherein said flap extensions are glued to outside surfaces of respective ones of said reinforcing end panels.

5. The box construction of claim 4 wherein said opposite end panels each have a width dimension less than a corresponding width dimension of said bottom panel.

6. The box construction of claim 4 wherein a combined width dimension of each of said opposite end panels and a respective pair of said side panel flap extensions is substantially equal to said width dimension of said bottom panel.

7. The box construction of claim 3 wherein said at least one stacking aperture is confined to said bottom panel, such that each of said opposite end panels presents a continuous solid surface across a lower edge thereof.

8. The box construction of claim 1 wherein each of said reinforcing end panels is provided with another stacking projection in addition to said at least one stacking projection, both of said stacking projections spaced along an upper edge thereof, and further wherein each of said minor flap portions is provided with a pair of apertures to thereby permit folding of said minor flap portions to said horizontal orientation with said stacking projections extending upwardly through said apertures.

9. The box construction of claim 3 wherein each of said reinforcing end panels is provided with cut-outs spaced along lower edges thereof and aligned with said stacking apertures in said bottom panel.

10. The box construction of claim 8 wherein said bottom panel is provided with a pair of stacking apertures along opposite end edges thereof, aligned and adapted to receive stacking projections of a substantially identical underlying box in a stacked arrangement of a plurality of boxes.

11. A box blank for forming a box, said blank comprised of a substantially planar sheet having opposite longitudinally extending marginal edges and having defined therein in a longitudinal direction of the blank a first partial top panel, a first side panel, a bottom panel, a second side panel and a second partial top panel; and wherein first and second full box depth but partial box width end panels extend transversely from said bottom panel, said first and second end panels having respective first and second minor flap portions along respective outer ends thereof, and further wherein said first and second side panels have first and second side panel flap extensions adapted to abut said end panels to define a full box width.

12. The box blank of claim 11 wherein said planar sheet is formed with a plurality of fold lines extending transversely between said marginal edges, said plurality of fold lines defining at least each of said first and second partial top panels, said first and second side panels and said bottom panel.

13. The box blank of claim 12 wherein said planar sheet is formed with a plurality of longitudinal fold lines extending parallel to said marginal edges, said longitudinal fold lines defining each of said first and second end panels, said first and second minor flap portions, and said first and second side panel flap extensions.

14. The box blank of claim 11 wherein each of said side panels includes a central portion flanked by transition strips extending transversely between said marginal edges, said transition strips each having a plurality of vent apertures formed therein.

15. The box blank of claim 13 wherein said bottom panel is formed with a pair of longitudinally spaced apertures along each of said marginal edges, and further wherein each of said minor flap portions is formed with a pair of apertures along one of said plurality of longitudinal fold lines defining said minor flap portion, said pairs of apertures in said bottom panel and said pairs of apertures in said minor flap portions being in substantial transverse alignment.

16. The box blank of claim 11 wherein said side panel flap extensions extend transversely from opposite marginal ends of each of said first and second side panels.

17. The box blank of claim 11 in combination with a pair of reinforcing end panels, each of said reinforcing end panels having a pair of shaped projections along an upper end thereof, and a pair of similarly shaped cut-out along a lower edge thereof, each of said reinforcing end panels adapted to be glued directly to interior surfaces of a respective one of said first and second end panels and associated side panel flap extensions.

18. The box blank of claim 15 in combination with a pair of reinforcing end panels, each of said reinforcing end panels having a pair of shaped projections along an upper edge thereof, and a pair of similarly shaped cut-out along a lower edge thereof, each of said reinforcing end panels adapted to be glued directly to interior surfaces of a respective one of said first and second end panels and associated side panel flap extensions.

19. The box blank of claim 11 wherein said blank is formed of single wall corrugated cardboard.

20. The box blank of claim 17 wherein each of said reinforcing end panels is constructed of a blank folded so as to provide triple thickness.

21. The box blank of claim 11 wherein said blank is formed of double wall corrugated cardboard.

* * * * *